US008721478B2

(12) United States Patent
Yu

(10) Patent No.: US 8,721,478 B2
(45) Date of Patent: May 13, 2014

(54) WEIGHT CHANGEABLE RACKET

(75) Inventor: Kuo-Pin Yu, Taichung (TW)

(73) Assignee: Yuan Min An Enterprise Co., Ltd., Taichung (TW)

( * ) Notice: Subject to any disclaimer, the term of this patent is extended or adjusted under 35 U.S.C. 154(b) by 90 days.

(21) Appl. No.: 13/469,383

(22) Filed: May 11, 2012

(65) Prior Publication Data

US 2012/0289367 A1 Nov. 15, 2012

(30) Foreign Application Priority Data

May 11, 2011 (CN) ..... 2011 2 0152200 U

(51) Int. Cl.
*A63B 49/04* (2006.01)
*A63B 49/02* (2006.01)

(52) U.S. Cl.
USPC ..... 473/519; 473/521; 473/546

(58) Field of Classification Search
USPC ..... 473/519, 546, 531, 524
See application file for complete search history.

(56) References Cited

U.S. PATENT DOCUMENTS 1,897,515 A * 2/1933 Hedstrom ..... 403/376
4,550,909 A * 11/1985 Sommer ..... 473/546
4,915,382 A * 4/1990 Madsen ..... 473/531
2012/0289367 A1 * 11/2012 Yu ..... 473/519

FOREIGN PATENT DOCUMENTS

JP 10076025 A * 3/1998 ..... A63B 49/02

* cited by examiner

*Primary Examiner* — Raleigh W Chiu
(74) *Attorney, Agent, or Firm* — Muncy, Geissler, Olds & Lowe, P.C.

(57) ABSTRACT

A racket capable of being changed in its weight includes handle, a main body, at least one nut embedded in the main body, and at least one bolt threadedly engaged with the nut. The main body has a frame and a connection portion connected between the frame and the handle. Because bolts having different weights can be selectively used to be threaded into the nuts, the user can adjust the overall weight of the racket according to his/her need so as to have a suitable racket.

7 Claims, 9 Drawing Sheets

WEIGHT CHANGEABLE RACKET

BACKGROUND OF THE INVENTION

1. Field of the Invention

The present invention relates generally to sports equipments and more particularly, to a racket capable of being changed in its weight.

2. Description of the Related Art

It is known that the balance of a racket, such as tennis racket, squash racket or badminton racket, may affect the user's sense of ball hitting. Generally, a racket is classified to a heavy-head racket having a better ball-hitting ability suitable for attack if the balance thereof is located adjacent to the head of the racket. On the contrary, if the balance of a racket is located adjacent to the handle of the racket, the racket will be a light-head racket having a better ball-controlling ability suitable for defense. Most of the powerful players choose the heavy-head rackets having a higher swing weight to enhance the ball-hitting power and speed. For a defensive type player, a light-head racket may be chosen for enhancing his/her ball-controlling performance.

Since the definition and requirement of 'a suitable racket' may vary from people to people, the seller needs to exhibit various kinds of rackets having different weights in his/her store. This is space-consuming and not cost effective.

SUMMARY OF THE INVENTION

The present invention has been accomplished in view of the above-noted circumstances. It is therefore one objective of the present invention to provide a racket which is capable of being changed in its weight according to the user's need.

To achieve the above-mentioned objective, a racket provided by the present invention comprises a handle, a main body, at least one nut mounted in the main body, and at least one bolt threadedly engaged with the nut. The main body has a frame, a connection portion connected between the handle and the frame, and at least one receiving hole. The nut is mounted in the receiving hole of the main body in a way that an outer periphery of the nut is firmly abutted with a surrounding wall of the receiving hole. By means of engaging a bolt of different weight with the nut, the overall weight of the racket is changed so as the swing weight.

Preferably, a radial crosssection of the nut has a non-circular circumferential contour, thereby preventing the nut from rotation relative to the main due to an exceeding tightening force in the process of tightening the bolt. This configuration can avoid the rotation of the nut, which may cause an insufficient engaging force between the bolt and the nut.

For the nut, a rivet nut, which can be firmly mounted in the receiving hole by a rivet nut gun, can be used. Alternatively, the nut may be firmly mounted in the receiving hole by adhesive. In this case, an adhesive layer is provided between the nut and the surrounding wall of the receiving hole.

Preferably, the main body is provided with a recess for receiving at least a part of the bolt.

Preferably, the main body is provided at an outer surface thereof with a shield for covering at least a part of the bolt, such that the main body may have a streamline profile for lowering the drag as the racket is swung.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
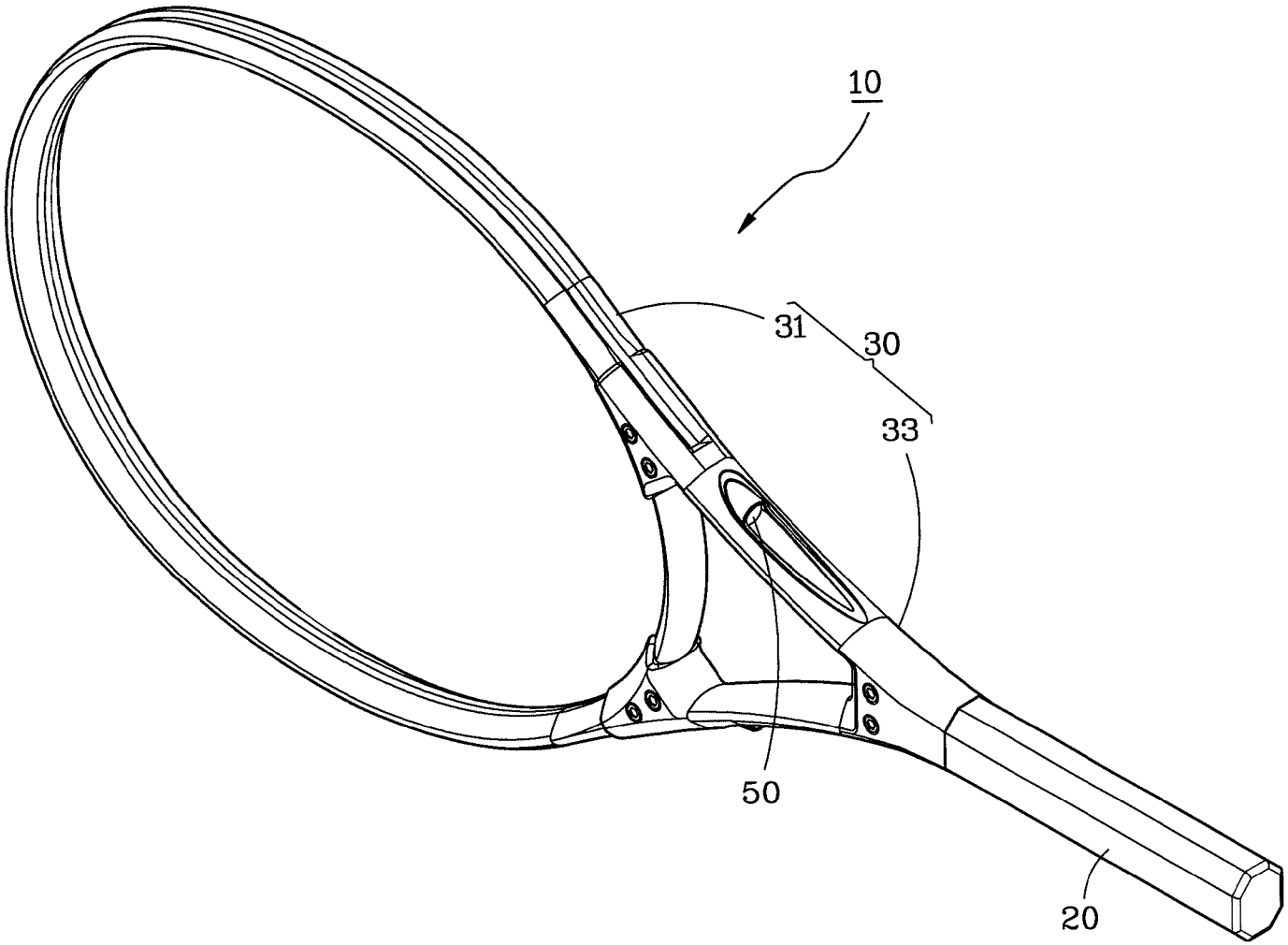
FIG. 1 is a perspective view of a weight changeable racket according to a first preferred embodiment of the present invention.
Figure 2:
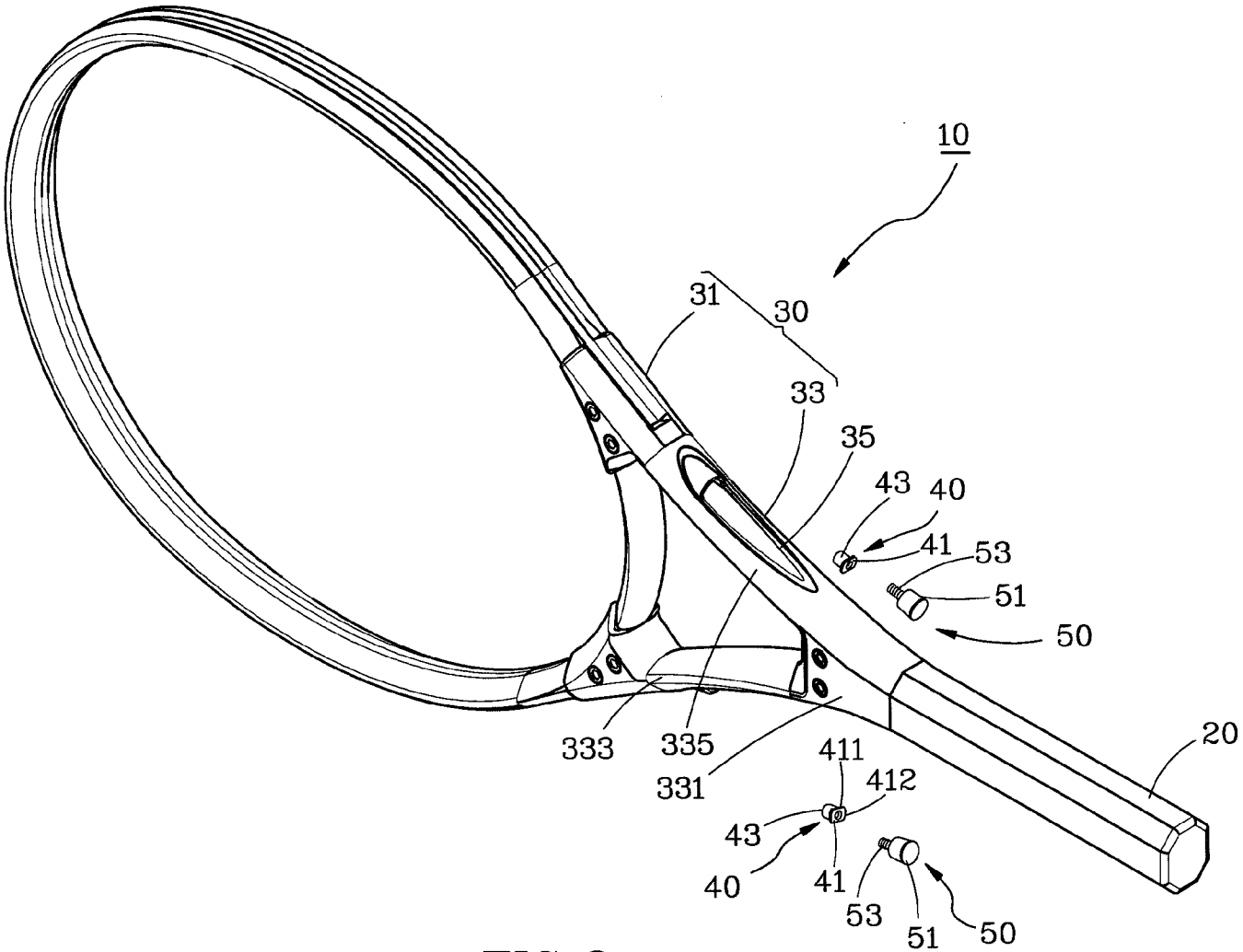
FIG. 2 is a partially exploded perspective view of the weight changeable racket according to the first preferred embodiment of the present invention.

Referring to FIGS. 1-2, a weight changeable racket 10 in accordance with a first preferred embodiment of the present invention comprises a handle 20, a main body 30, two nuts 40, and two bolts 50.

The main body 30 is made from a composite material containing carbon fiber. The main body 30 includes a frame 31 and a connection portion 33 connected between the frame 31 and the handle 20. In this embodiment, the connection portion 33 has a shank 331, which is connected with the handle 20 and located at a center axis of the main body 30, and a left arm 333 and a right arm 335 connected between the shank 331 and the frame 31 and located at two sides of the center axis of the main body 30 respectively.

The nuts 40 each have a head 41 and a body 43 with an internal thread. The head 41 of the nut 40 includes, but not limited to, two parallel flat cuts 411, and two curved surfaces 412 connected between the flat cuts 411 respectively. In fact, as long as the nut 41 has a radial crosssection with a non-circular circumferential contour, it can prevent the nut 40 from rotation relative to the main body 30, which tends to happen due to an exceeding tightening force and which may cause an insufficient engaging force between the bolt 50 and the nut 40. It'll be appreciated that a nut having a head with a circular circumferential contour can also be used if the nut can be firmly mounted in the main body 30 when the racket is made.

Each bolt 50 is threadedly engaged with one nut 40. The bolt 50 has a head 51 and a threaded shank 53.

Figure 3:
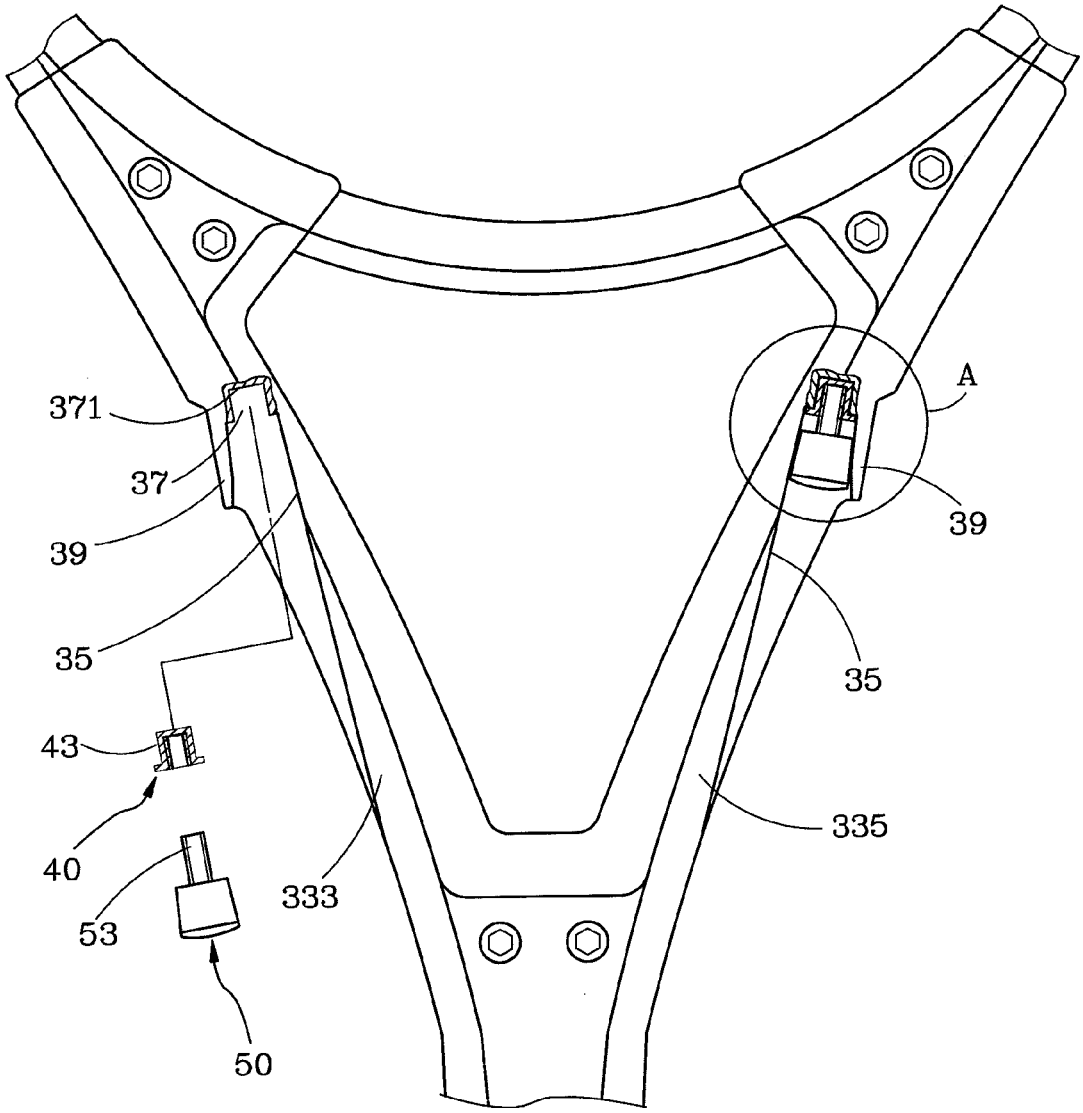
FIG. 3 is a partially-exploded and partially-cutaway plan view of a part of the weight changeable racket according to the first preferred embodiment of the present invention.
Figure 4:
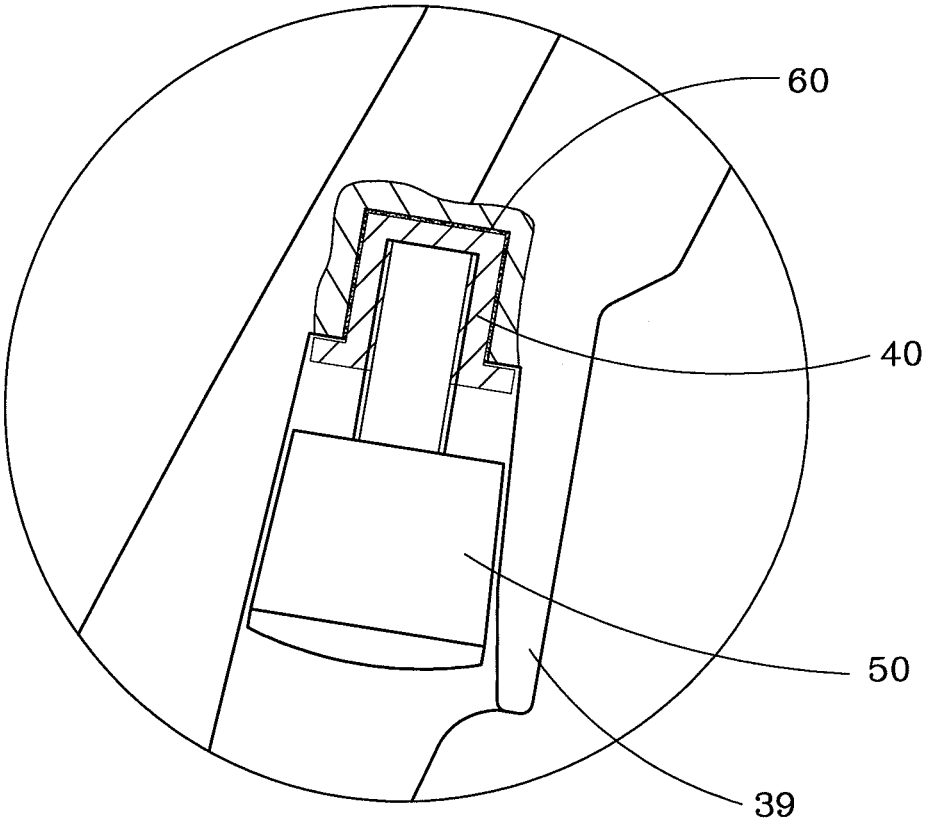
FIG. 4 is an enlarged view of the circle A in FIG. 3, showing that an adhesive layer is sandwiched between the surrounding wall of the receiving hole and the nut.

As shown in FIG. 3, the left and right arms 333 and 335 of the main body 30 each are provided with a recess 35. At the bottom wall of the recess 35, a receiving hole 37 is provided. In addition, on each of the surfaces of the left and right arms 333 and 335, a shield 39 is provided. The nuts 40 are respectively mounted in the receiving holes 37 by adhesive, such that an adhesive layer 60 is sandwiched between the nut 40 and the surrounding wall 371 of the receiving hole 37, and the outer periphery of the nut is tightly abutted with the surrounding wall 371 of the receiving hole 37. The threaded shanks 53 of the bolts 50 are respectively engaged with the bodies 43 of the nuts 40 in such a way that the threaded shanks 53 of the bolts are covered by the shields 53 respectively. This can reduce the drag as the racket is swung. The recess 35 can accommodates at least a part of the bolt 50 to conceal the bolt 50 inside the main body 30 so as to make the racket 10 of the present invention have a streamline profile.

By means of engaging a bolt 50 having a different weight with the nut 40, the racket 10 provided by the present invention can change its weight or center of gravity. Therefore, the user can adjust the weight of the racket 10 according to his/her need to make a racket suitable for him/her. By means of using the design provided by the present invention, the seller can provide custom-made rackets subject to various needs of different buyers without having to store a great amount of rackets of various specifications in his/her store at a time, such that the seller can save the exhibition space for rackets in his/her store. This is cost effective.

Figure 5:
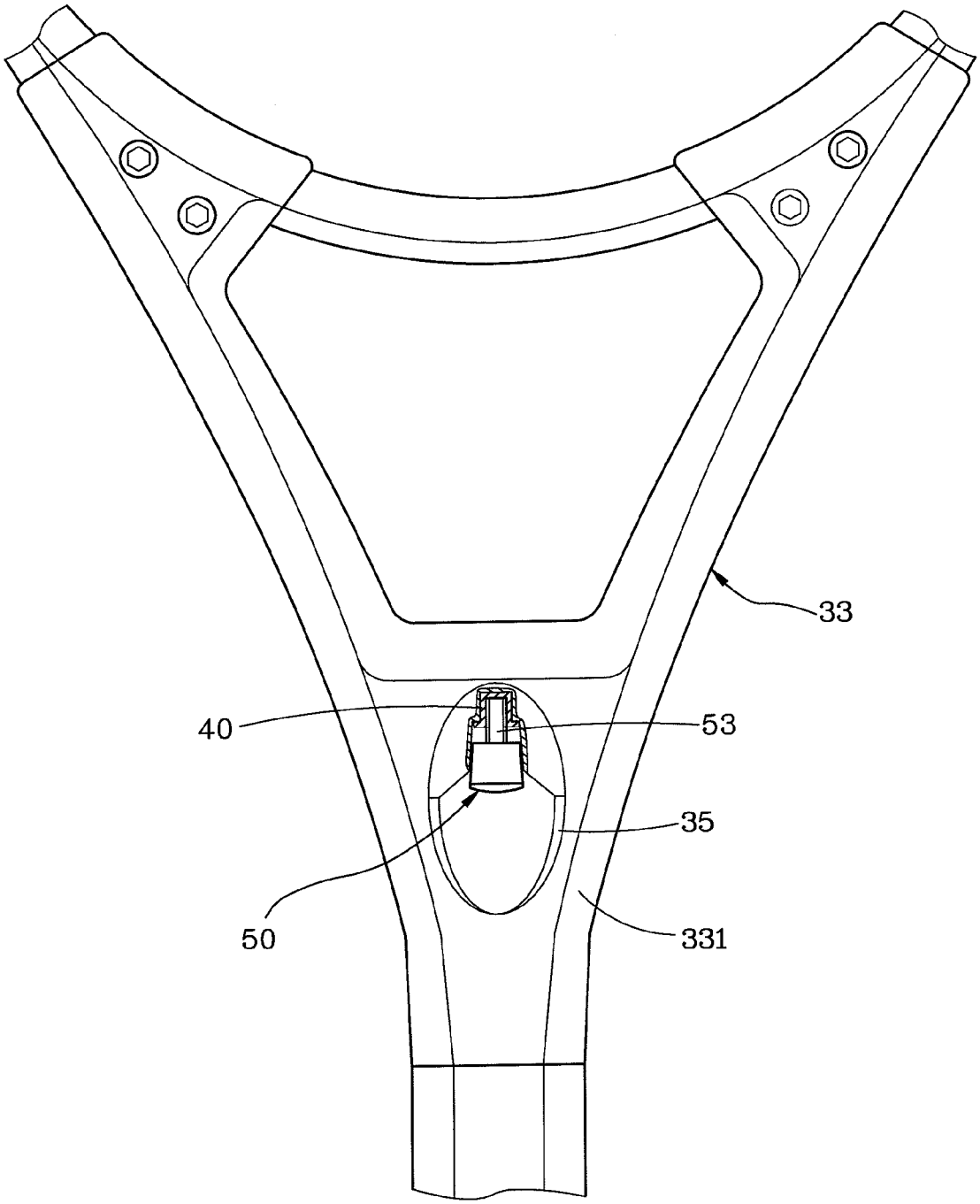
FIG. 5 is a partially cutaway plan view of a part of a weight changeable racket according to a second preferred embodiment of the present invention.
Figure 6:
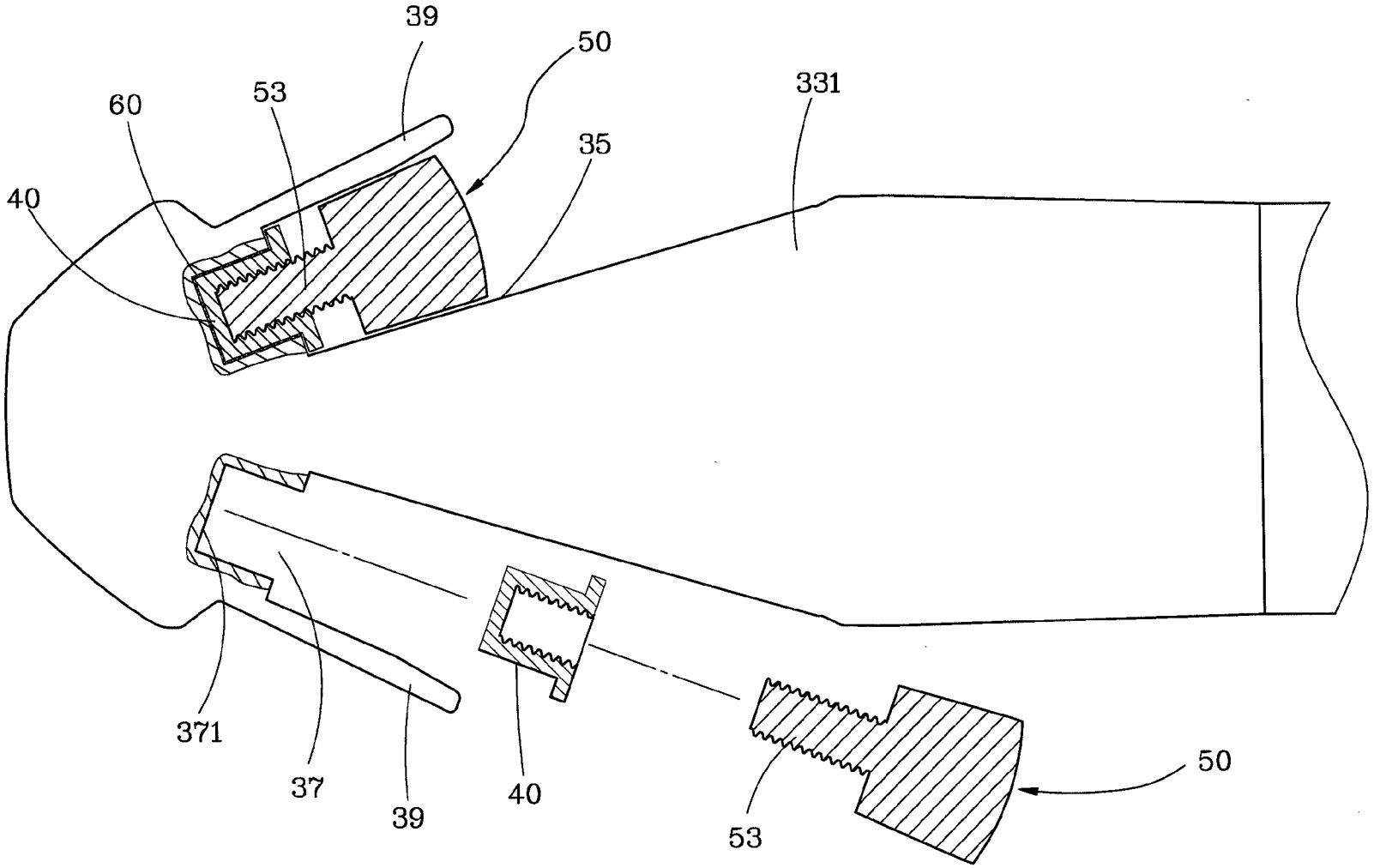
FIG. 6 is a partially-exploded and partially-cutaway plan view of a part of the weight changeable racket, showing the configuration of the receiving hole and an adhesive layer sandwiched between the surrounding wall of the receiving hole and the nut.

Based on the essential technical features of the present invention, the racket provided by the present invention may have various modifications in its design. For example, the recess 35 and the shield 39 can be eliminated according to the need of user/manufacturer. The nut 40 can be pre-embedded in the semi-product of the main body 30, which is made of pre-preg, i.e. pre-impregnated fiber fabric, such that the nut 40 will be firmly bonded to the main body 30 after the prepreg is cured. In addition, the bolt 50 can be made from plastic material, rubber material or metal material, such as aluminum alloy, stainless steel and titanium alloy. Further, taking the racket 10 in accordance with a second preferred embodiment of the present invention for example, as shown in FIGS. 5 and 6, the racket 10 is provided at each of the two sides of the shank 331 thereof with a recess 35, a receiving hole 37 and a shield 39. Two nuts 40 are respectively received in the two receiving holes 37 and each recess 35 accommodates one nut 40 and one bolt 50. In addition, an adhesive layer 60 is also provided between the nut 40 and the surrounding wall 371 of the receiving hole 37, and the threaded shank 53 of the bolt 50 is threadedly engaged with the nut 40 and entirely covered by the shield 39.

Figure 7:
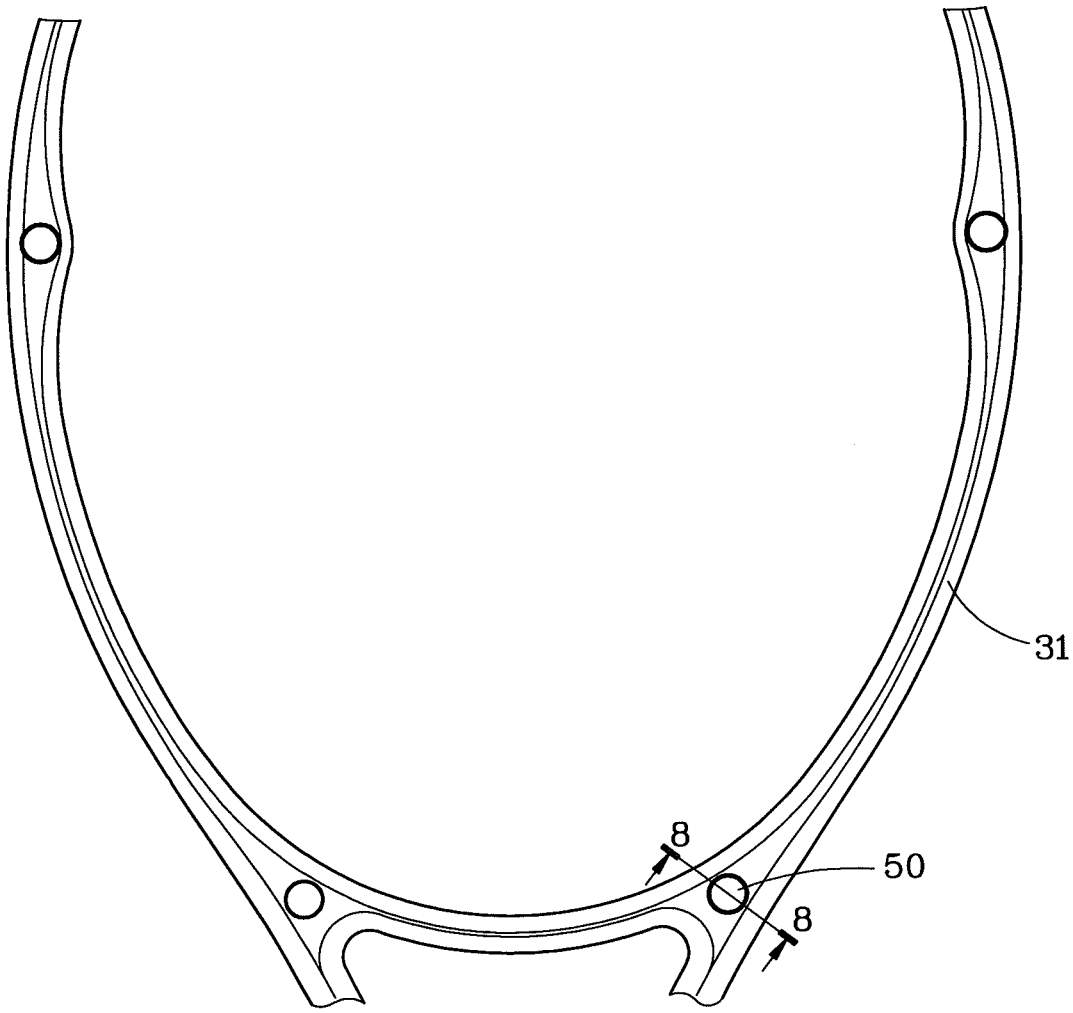
FIG. 7 is a schematic drawing showing a part of a weight changeable racket according to a third preferred embodiment of the present invention.
Figure 8:
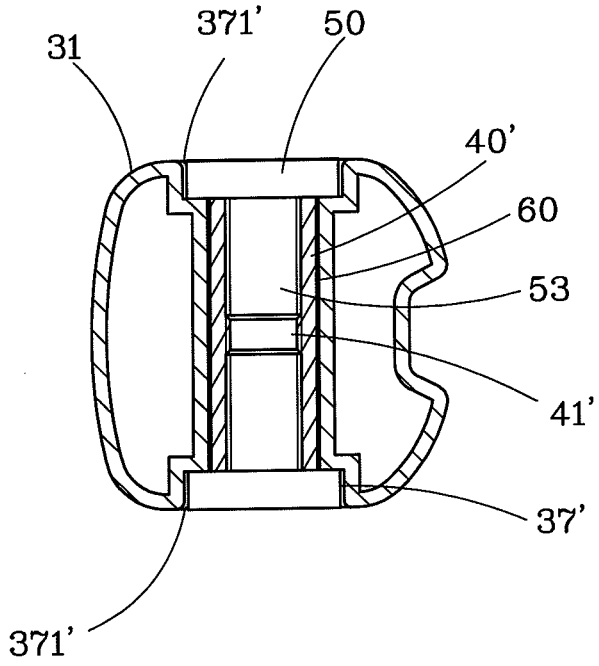
FIG. 8 is a sectional view taken along line 8-8 of FIG. 7.

FIGS. 7 and 8 show a racket 10 provided by a third preferred embodiment of the present invention. The racket 10 comprises a plurality of nuts 40' mounted in the frame 31 of the main body and a plurality of bolts 50. The nut 40' is provided with a threaded through hole 41'. The main body 30 is provided with receiving holes 37' each penetrating through the frame 31, such that each receiving hole 37' has two openings 371' at two end thereof. The nut 40' can be firmly mounted in the receiving hole 37' by adhesive. In this case, an adhesive layer 60 exists between the surrounding wall of the receiving hole 37' and the nut 40'. The threaded shanks 53 of two bolts 50 are respectively inserted through the two openings 371' of one receiving hole 37' and then threadedly engaged with the threaded through hole 41' of the nut 40' mounted in the receiving hole 37'.

Figure 9:
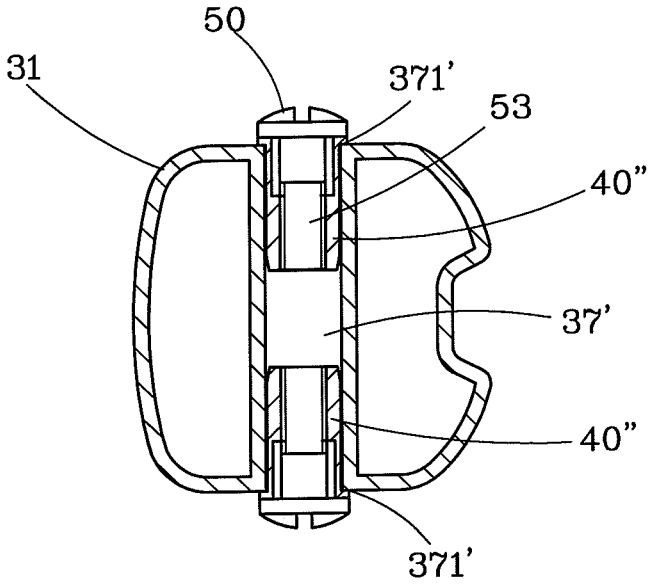
FIG. 9 is sectional view showing that the nuts are rivet nuts mounted in the receiving hole.

In addition, the way of mounting the nut is not limited to adhesion. For example, as shown in FIG. 9, two nuts 40", which are rivet nuts in this embodiment, are firmly mounted in the receiving hole 37' by a rivet nut gun (not shown in the drawing). Thereafter, the threaded shanks 53 of two bolts 50 are respectively inserted through the two openings 371' of the receiving hole 37' and then threadedly engaged with the threaded holes of the nuts 40" respectively.

Figure 10:
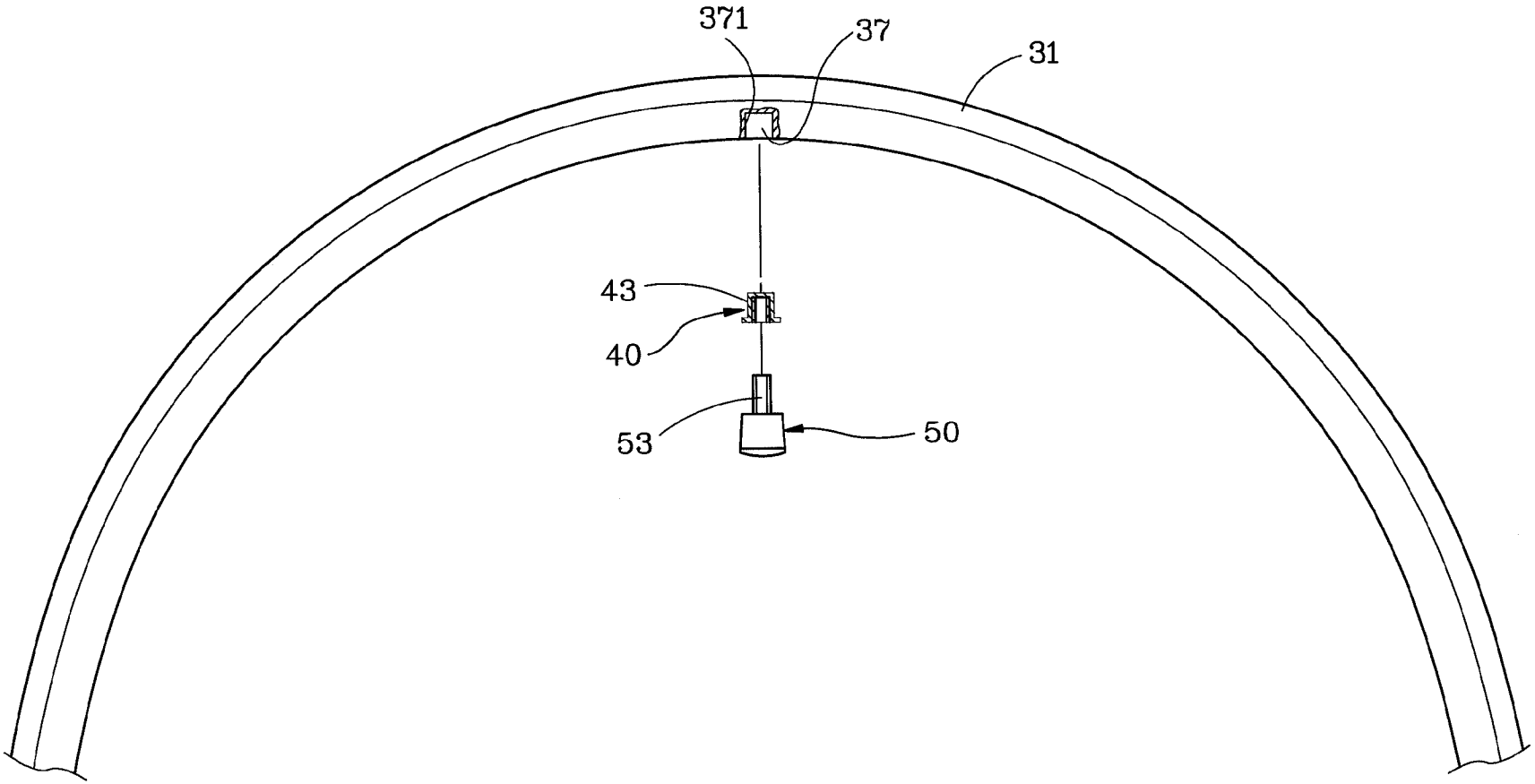
FIG. 10 is a partially cutaway plan view of a part of a weight changeable racket according to a fourth preferred embodiment of the present invention.

FIG. 10 shows a racket 10 in accordance with a fourth preferred embodiment of the present invention. the receiving hole 37 is provided at a top central portion of the frame 31 of the main body, and the nut 40 can be mounted in the receiving hole 37 by adhesive or a rivet nut gun in such a way that the outer periphery of the nut 40 is firmly abutted with the surrounding wall 371 of the receiving hole 37. Similarly, the threaded shank 53 of the bolt 50 is threadedly engaged with the body 43 of the nut 40.

The above-mentioned modifications as would be obvious to one skilled in the art are intended to be included within the scope of the following claims.

What is claimed is:

1. A weight changeable racket, comprising:

a handle;

a main body having a frame, a connection portion integrally extending from the frame and connected with the handle, and at least one receiving hole recessed on an outer surface of the frame or an outer surface of the connection portion;

at least one nut mounted in said at least one receiving hole of the main body in a way that an outer periphery of the nut is firmly abutted with a surrounding wall of the receiving hole; and at least one bolt threadedly engaged with said at least one nut.

2. The weight changeable racket of claim 1, wherein a radial cross-section of the nut has a non-circular circumferential contour.

3. The weight changeable racket of claim 1, wherein the nut is a rivet nut.

4. The weight changeable racket of claim 1, wherein an adhesive layer is sandwiched between the nut and the surrounding wall of the receiving hole.

5. The weight changeable racket of claim 1, wherein the main body is provided with a recess for receiving at least a part of the bolt.

6. The weight changeable racket of claim 1, wherein the main body is provided at an outer surface thereof with a shield for covering at least a part of the bolt.

7. A weight changeable racket, comprising:

a handle;

a main body having a frame, a connection portion connected between the handle and the frame, and at least one receiving hole;

at least one nut mounted in said at least one receiving hole of the main body in a way that an outer periphery of the nut is firmly abutted with a surrounding wall of the receiving hole; and two bolts threadedly engaged with said at least one nut;

wherein the receiving hole penetrates through the main body, such that the receiving hole has two opposite openings through which said two bolts are inserted respectively.

* * * * *